United States Patent [19]

Janzen

[11] 4,398,566

[45] Aug. 16, 1983

[54] PIPE THREAD PROTECTOR APPARATUS

[76] Inventor: Harlo W. Janzen, Box 356, Fairview, Okla. 73737

[21] Appl. No.: 287,254

[22] Filed: Jul. 27, 1981

[51] Int. Cl.[3] ..... B65D 59/00

[52] U.S. Cl. ..... 138/96 T; 24/269

[58] Field of Search ..... 24/20 TT, 20 LS, 269; 81/117.5 T; 138/96 R, 96 T, 99, 89, 90; 220/320, 321, DIG. 19

[56] References Cited

U.S. PATENT DOCUMENTS

| | | | |
|---|---|---|---|
| 1,745,279 | 1/1930 | Skinner | 24/269 |
| 1,874,731 | 8/1932 | Younce | 24/269 UX |
| 3,006,379 | 10/1961 | Hauk | 138/89 |
| 3,038,502 | 6/1962 | Hauk et al. | 138/96 T |
| 3,240,232 | 3/1966 | Matherne | 138/96 T |
| 3,882,753 | 5/1975 | Svensen | 81/177.5 T |
| 4,205,707 | 6/1980 | Lundgren | 138/96 T X |
| 4,349,048 | 9/1982 | Clark | 138/96 R X |

*Primary Examiner*—Stephen Marcus
*Assistant Examiner*—Mark John Thronson
*Attorney, Agent, or Firm*—Laney, Dougherty, Hessin & Beavers

[57] ABSTRACT

A pipe thread protector apparatus which includes an annular elastomeric sleeve dimensioned to surround a pipe thread to be protected, a radially inwardly projecting stop flange at one end of the sleeve and a constriction subassembly for constricting the sleeve into gripping contact with the protected thread. The constriction subassembly includes a flexible band imbedded in the sleeve, and a device for shortening the length of the band to constrict the elastomeric sleeve.

16 Claims, 8 Drawing Figures

PIPE THREAD PROTECTOR APPARATUS

FIELD OF THE INVENTION

This invention relates to pipe thread protector devices.

BRIEF DESCRIPTION OF THE PRIOR ART

The following statement is intended to be a prior art statement in compliance with the guidance and requirements of 37 C.F.R. §§1.56, 1.97 and 1.98.

In the production of oil and gas from deep subterranean locations, it is necessary to employ elongated strings of drill pipe, production tubing or casing made up of multiple sections of tubular members axially interconnected at threaded joints. These strings are usually at least one mile in length and sometimes exceed four miles in length. Because of the resultant great stress imposed upon them, it is therefore of great importance that the pipe threads used to interconnect sections be undamaged and formed in true concentricity around the pipe. Since drill pipe and casing are subjected to rough treatment during handling and making up string, it is easy for the threaded end portions at the end of each tubular section to become damaged by impact with other objects. Accordingly, various devices have been used to surround and cover the pipe threads, thus protecting and shielding the threads from impact with various objects until the time the joint connections are made.

One patent known to me which is directed to a thread protector having some general similarity to that which I have invented is U.S. Pat. No. 2,161,197 issued to Protin. The Protin patent thread protector includes a sleeve portion which is dimensioned to surround an external thread on a pipe end, and which may be caused to engage the pipe to protect the threads thereof by means of a cam mechanism. The cam mechanism includes a lever carrying a cam-like surface on one end which engages a plate extending across the sleeve. A bar is attached to the cam lever and extends into the interior of the pipe to there engage a bendable strut. By causing the cam surface to engage the plate, the strut can be bent to a position in which it grips the internal surface of the pipe to thereby hold the thread protector in place with the sleeve surrounding the threads on the outer side of the pipe.

Baker U.S. Pat. No. 2,547,992 relates to an apparatus for protecting pipe threads, which apparatus includes a cam surface which can be caused to bear against a ball at one end of a bar so as to cause lateral displacement of pins located internally of the pipe against the interior of the pipe, and thereby retain the protector in place on the pipe. A patent generally similar to this Baker patent is a second patent issued to Baker, i.e. U.S. Pat. No. 2,513,613.

In FIGS. 12 through 16 of Hauk et al. U.S. Pat. No. 3,038,502, a rubber external sleeve is illustrated as a part of a thread protector, and this external sleeve encloses a steel reinforcing band to enhance the structural strength of the external sleeve. The external sleeve is fixed around the pipe to afford protection to the threads.

Mickelson U.S. Pat. No. 2,727,651 shows a thread protector having a rubber external sleeve and a rubber internal element positioned to frictionally engage the inner side of the pipe and thereby hold the protector in place.

In Zinn U.S. Pat. No. 2,707,387, retention of the thread protector in position around the pipe is accomplished by means of an internally located compressible rubber block or plug. The plug is compressed to cause it to expand radially into engagement with the internal wall of the pipe.

It is with respect to the foregoing described prior art patents that the present invention constitutes an improvement facilitating ease of installation for use, and subsequent quick disconnect removal of the thread protector from the pipe end.

GENERAL DESCRIPTION OF THE PRESENT INVENTION

The present invention provides an improved pipe thread protector device which includes an annular elastomeric sleeve dimensioned to surround a pipe thread to be protected. Toward one end of the sleeve, a radially inwardly projecting stop flange or plate is provided to limit movement of the sleeve axially over the pipe end. A constriction subassembly is attached to the sleeve for constricting the sleeve into gripping contact with the thread to be protected. The constriction subassembly includes a flexible band embedded in the sleeve and extending around the sleeve to terminate at a locus within the sleeve where a portion of a device employed for shortening the length of the band is located. The band shortening device may take one of several forms, including a spool or drum upon which one end of the flexible band is rolled to cause it to undergo constriction and reduction in length. In another form, the shortening device is a sprocket element which engages apertures formed through the band to draw one end of the band past the sprocket, thereby shortening the overall length of the band. Whether the drum or sprocket form of the shortening device is used, a shaft is secured to the drum or the sprocket and projects through the body of the annular elastomeric sleeve in an axial direction so as to provide one end of the shaft which protrudes from one end of the sleeve. The protruding end of the shaft is splined to facilitate connection to a handle element which can be pivoted to cause the drum or the sprocket to undergo rotation, and thereby effect shortening of the flexible band.

When the band is shortened in the manner described, it causes a constriction of that portion of the elastomer of the sleeve which lies radially inwardly from the flexible band so that the elastomer is brought into frictional engagement with the threads of the pipe and the thread protector device is retained in position on the pipe end.

An important object of the invention is to provide a pipe thread protector apparatus which can be very quickly and easily placed in a protective position over the threaded end of a pipe to shield and protect the threads carried thereon, and which can be quickly and easily removed from the pipe when the threads are to be engaged in making up a joint.

Another object of the invention is to provide a pipe thread protector device which can be manually secured and positioned to protect the threads on a pipe end, and can be quickly detached when the threads are to be engaged in forming a joint.

A further object of the invention is to provide a pipe thread protector which is mechanically rugged and durable, yet relatively simple in its mechanical and functional makeup so that it can be relatively economically manufactured, and can be repaired easily, and in most cases, in the field.

Additional objects and advantages of the invention will become apparent as the following detailed description of the invention is read in conjunction with the accompanying drawings which illustrate preferred embodiments of the invention.

GENERAL DESCRIPTION OF THE DRAWINGS

DETAILED DESCRIPTION OF PREFERRED EMBODIMENTS OF THE INVENTION

Figure 1:
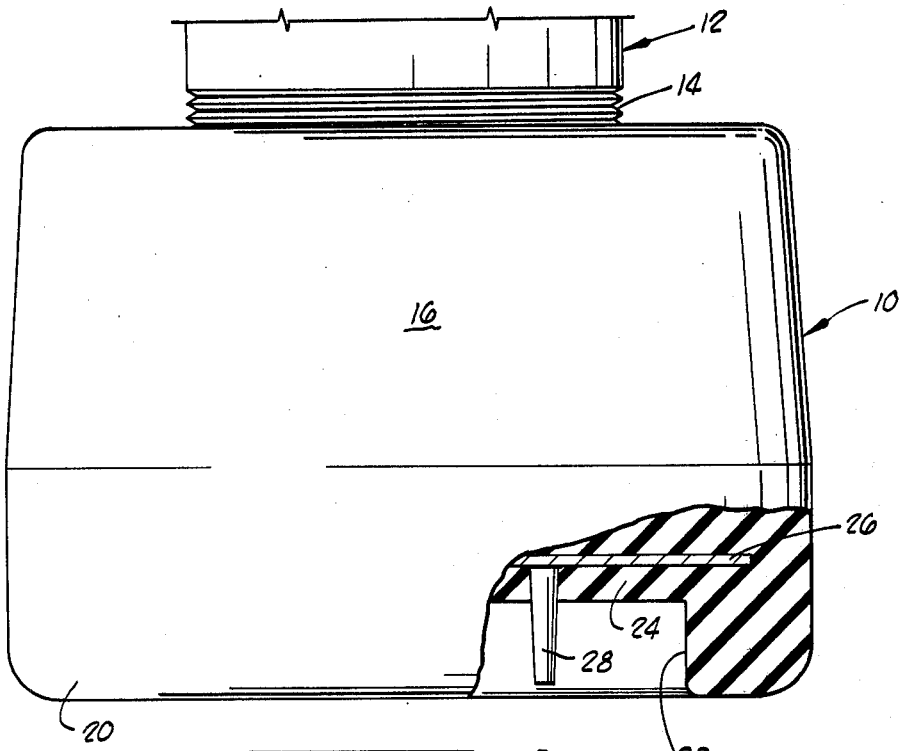
FIG. 1 is a side elevation view of one embodiment of a pipe thread protector apparatus constructed in accordance with the invention, with a portion of the thread protector device shown broken away.

Referring initially to FIG. 1 of the drawings, a pipe thread protector apparatus constructed in accordance with the invention is designated generally by reference numeral 10, and is shown in its operative position over one end of a section of pipe 12. The pipe section 12 carries terminal external threads 14.

Figure 3:
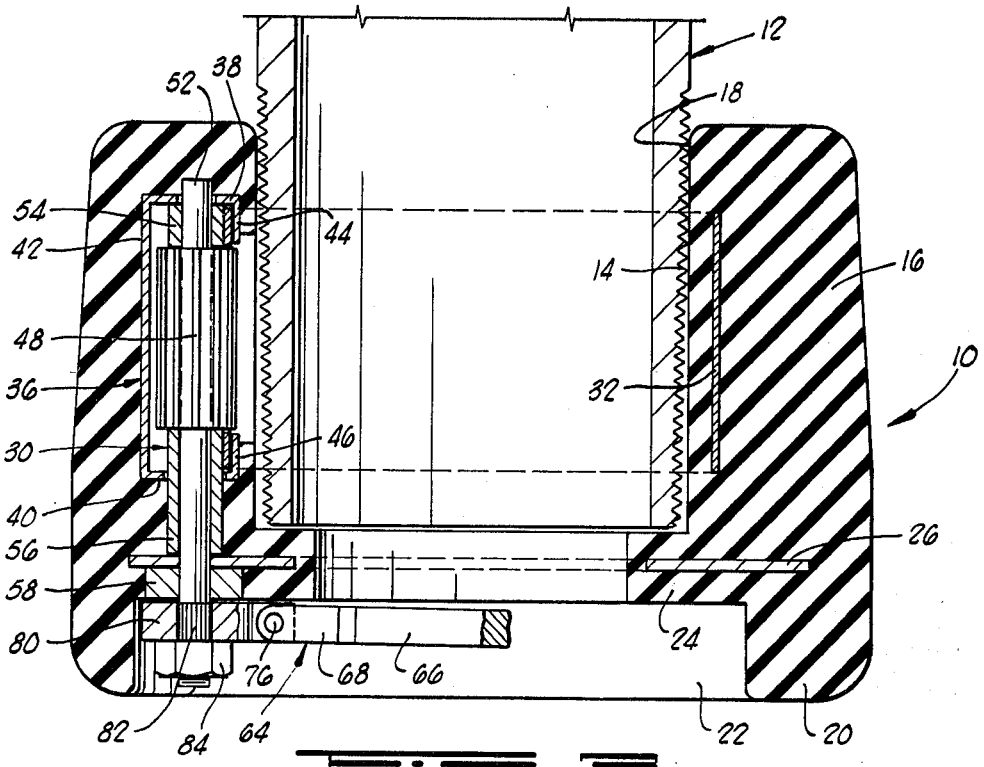
FIG. 3 is a vertical sectional view taken through the thread protector apparatus illustrated in FIG. 1.

The thread protector apparatus 10 includes an annular body of elastomeric material forming a sleeve 16 which defines an internal bore or opening 18 dimensioned to fit over and surround the external threads 14 carried on the pipe section 12. The sleeve 16 includes an integrally formed, axially extending skirt 20 which projects a substantial distance past the end of pipe section 12 and defines a large, central opening 22. A radially inwardly extending stop flange 24 is also formed integrally with the elastomeric body of the sleeve 16 and projects radially inwardly to a location affording a stop or interference element limiting movement of the sleeve 16 up onto the threaded end of the pipe section 12. The stop flange 24 and the elastomeric sleeve 16 are reinforced by a radially extending metallic plate 26 which is embedded in the sleeve 16 and projects radially inwardly within the stop flange 24 as shown in FIG. 3. Projecting downwardly from the reinforcing plate 26 through the elastomeric material of the stop flange 24, and within the outer portion of the opening 22 is at least one frusto-conical latching stud 28.

Figure 4:
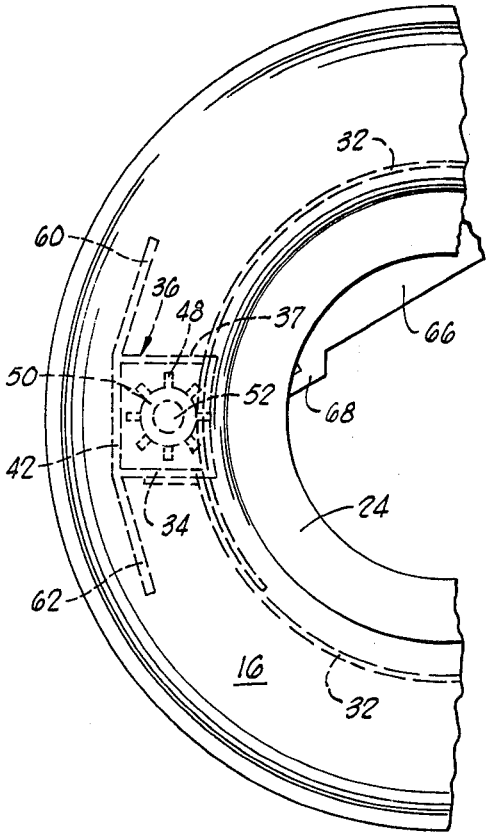
FIG. 4 is a top plan view of a portion of the thread protector apparatus shown in FIG. 1, and illustrating in dashed lines, certain structure located internally of the elastomer body employed in a sleeve forming a portion of the thread protector.
Figure 5:
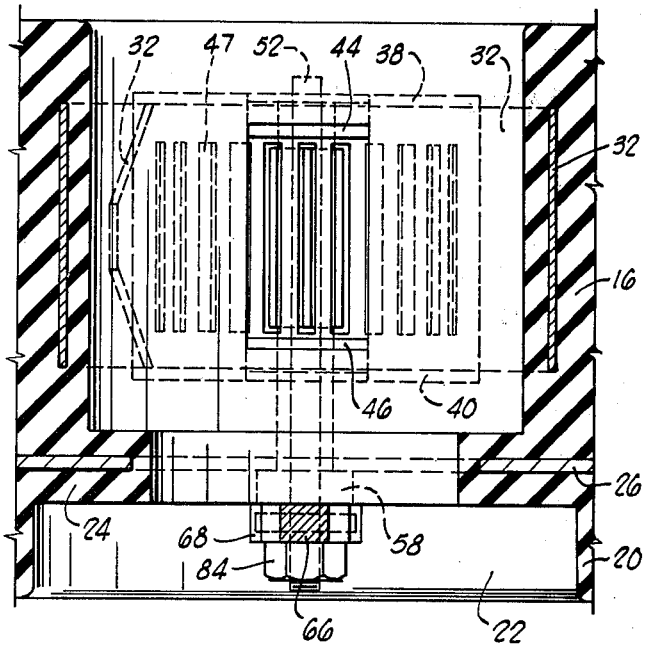
FIG. 5 is an enlarged detail sectional view showing a portion of the thread protector apparatus illustrated in FIG. 1.

For the purpose of permitting the elastomer within the sleeve 16 to be constricted so as to grip and frictionally engage the threads 14 on the pipe end, a constriction subassembly, designated generally by reference numeral 30, is provided. The constriction subassembly 30 can be variously constructed, but two preferred forms of such subassembly are illustrated in FIGS. 3–5 and in FIGS. 6–8 of the drawings. Reference will initially be made to the form of the constriction subassembly depicted in FIGS. 3–5.

The constriction subassembly 30 shown in FIG. 3 includes an elongated, generally circularly shaped flexible constriction band 32 which is embedded in the elastomer of the sleeve 16 and is displaced relatively near to the radially inner side of the body of elastomeric material in the sleeve. The band 32 extends around the sleeve, and has one of its ends secured in any suitable fashion to one side wall 34 of a sprocket housing designated generally by reference numeral 36. A second side wall 37 of the housing extends substantially parallel to the first side wall 34. The sprocket housing 36 further includes a top wall 38, a bottom wall 40 and a back wall 42. The top and bottom walls 38 and 40 project beyond the radially inner edges of the side walls 34 and 35 and are seucred to axially projecting guide flanges 44 and 46 as shown in FIG. 3. The guide flanges 44 and 46 function to receive and guide the free end of the flexible constriction band 32, and to retain this end portion, defining slots 47, in engagement with teeth 48 carried on a sprocket drum 50.

The sprocket drum 50 is keyed to an elongated operator shaft 52 which projects axially within the sleeve 16 and parallel to the side of the pipe section 12. The operator shaft 52 includes an upper end which projects through the top wall 38 of the sprocket housing 36. An upper sleeve 54 surrounds the upper end portion of the operator shaft 52 and is positioned within the sprocket housing 36 immediately over the sprocket drum 50. A lower sleeve 56 surrounds the operator shaft 52 below the sprocket drum 50 and bears at its end opposite the sprocket drum against a surface of the reinforcing plate 26. A bearing nut 58 surrounds the operator shaft 52 on the opposite side of the reinforcing plate 26 from the bearing sleeve 56.

As will be perceived from FIGS. 3 and 4 of the drawings, the sprocket housing 36 is embedded within the elastomeric body making up the sleeve 16. For stabilization of the sprocket housing 36 within the sleeve, a pair of rigid stabilizer wings 60 and 62 project from opposite sides of the housing, and are embedded in the elastomer.

Operator handle means 64 is operably connected to an end portion of the operator shaft 52 which projects axially beyond the stop flange 24 and into the opening 22 formed within the skirt 20. The operator handle means 64 includes an elongated operator handle 66 which has a bifurcated or forked end 68. At its opposite end, the handle has a stud receiving aperture 70 formed therethrough. Between the ends of the handle, a wire line pulley 72 is mounted for rotation about a pivot pin 74 secured to the opposite side of the handle from the side which faces the end of the pipe section 12 (See FIG. 2).

The bifurcated end portion 68 of the handle 66 is pivotally secured by means of a suitable pivot shaft 76 to one end of a protuberant neck 78 formed integrally with, and projecting radially from, a splined hub 80. The splined hub 80 engages splines 82 formed on the operator shaft 52 and is retained in its engaging status by means of a lock nut 84 threaded on the end of the operator shaft 52 as shown in FIG. 3.

In the operation and use of the embodiment of the thread protector apparatus shown in FIGS. 1–5, the operator handle 66 is first pivoted downwardly to disengage the apertured end thereof from the latching stud 28. The operator handle 66 is then pivoted from the full line position illustrated in FIG. 2 to the dash line position so as to impart a rotary motion to the operator shaft 52. The direction of pivotation of the handle 66 is such that the flexible constriction band 32 is relieved of tension and the elastomeric material positioned radially inside of this band within the sleeve 16 is relaxed and permitted to expand in a radially outward direction. When the constriction band 32 is thus slacked to increase its length and relieve the tension therefrom, the internal diameter of the sleeve 16 is enlarged and it is possible to then place the pipe thread protector over the threaded end of the pipe 12. The pipe thread protector 10 is positioned over the pipe to the location depicted in FIGS. 1 and 3. It will be perceived that in this position, the annular sleeve 16 of elastomeric material surrounds the pipe threads 14. Moreover, the end of the pipe abuts the stop flange 24.

Figure 2:
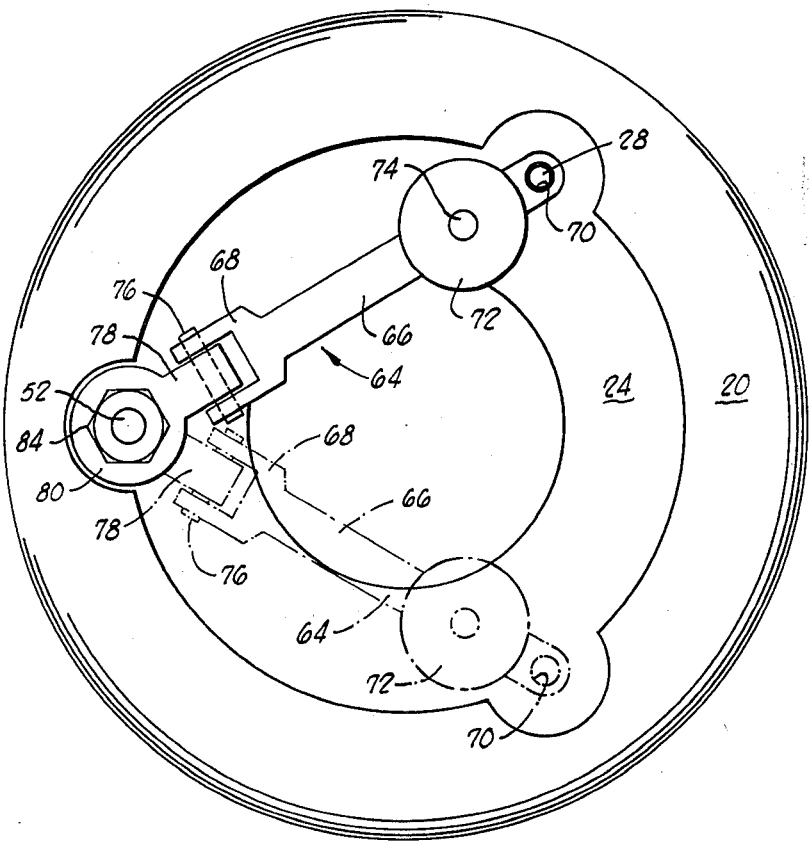
FIG. 2 is a bottom plan view of the pipe thread protector apparatus shown in FIG. 1, and illustrating in dashed lines an alternate operative position of an operator handle structure employed as a part of the thread protector apparatus.

With the threads thus protected by the thread protector device of the invention, the operator handle 66 is then pivoted back from the dash line position to the full line position illustrated in FIG. 2. This movement of the handle 66 causes the operator shaft 52 to rotate in a clockwise direction as viewed in FIG. 4, thereby moving the end portion of the flexible constriction band 32 which is in engagement with the teeth 48 of the sprocket drum 50 in a direction to tension and constrict the band. This movement of the flexible constriction band 32 constricts the elastomeric material located inside of the band sufficiently to cause relatively tight frictional engagement with the threads 14 on a pipe 12. The handle 66 is then pivoted upwardly so that the stud 28 passes through the aperture 70 in one end of the handle 66, thereby locking the handle against swivelling or pivoting movement in response to the tension in the flexible constriction band 32. The pipe thread protector 10 is thus locked in its protective position over the end of the pipe.

To release the thread protector device, the reverse pivoted movement of the handle is effected.

At a time when it may be desired to quickly shift the pipe thread protector from a position of use to an out-of-the-way position, such as off of a drilling rig platform, the pulley 72 carried on the handle 66 can be placed over a wire line, after the handle has been pivoted to an axially extending position, and the entire pipe thread protector allowed to slide down the wire line to a remote location.

Figure 6:
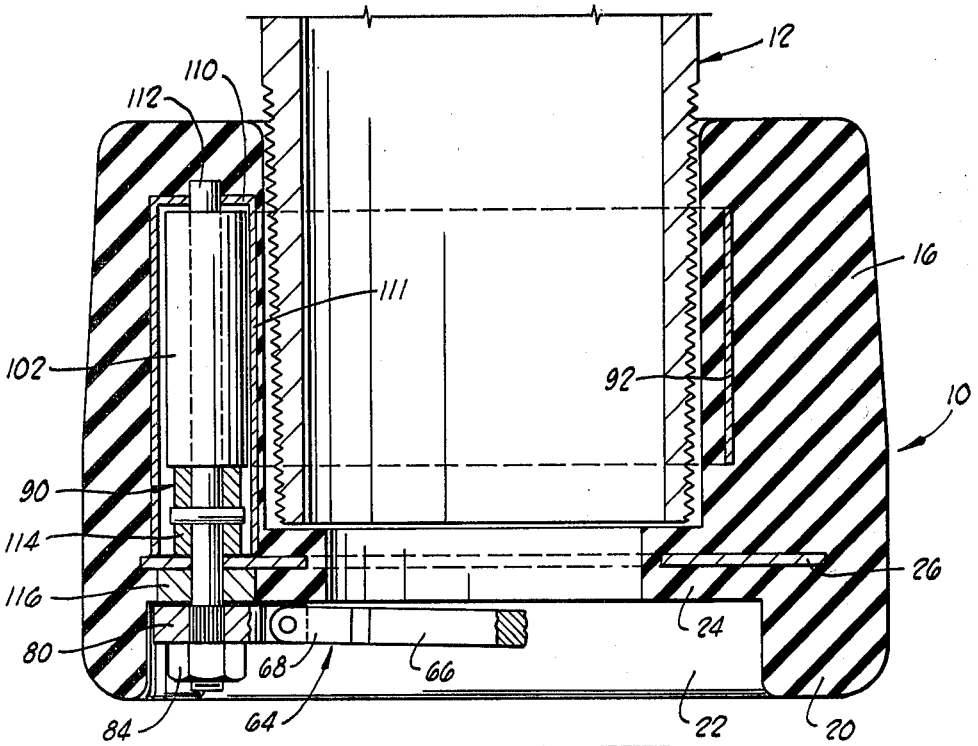
FIG. 6 is a vertical sectional view similar to that illustrated in FIG. 3, but depicting the details of construction of an alternate embodiment of the invention.
Figure 7:
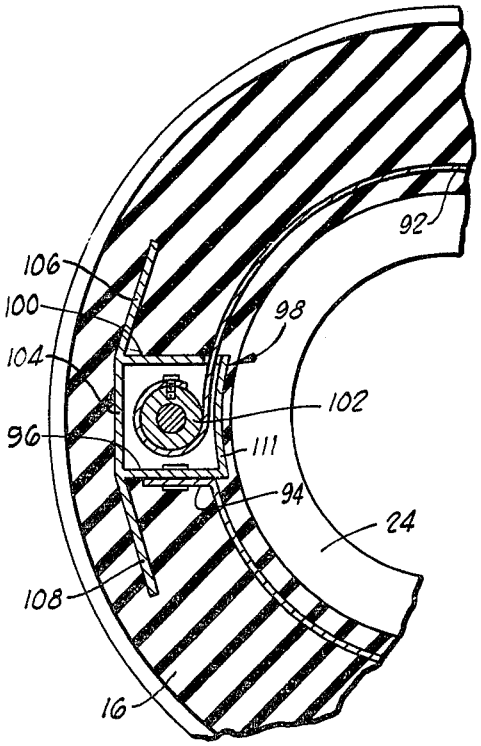
FIG. 7 is a horizontal sectional view taken through a part of the thread protector device illustrated in FIG. 6 and showing certain portions of a constriction subassembly employed in such alternate embodiment of the thread protector apparatus of the invention.
Figure 8:
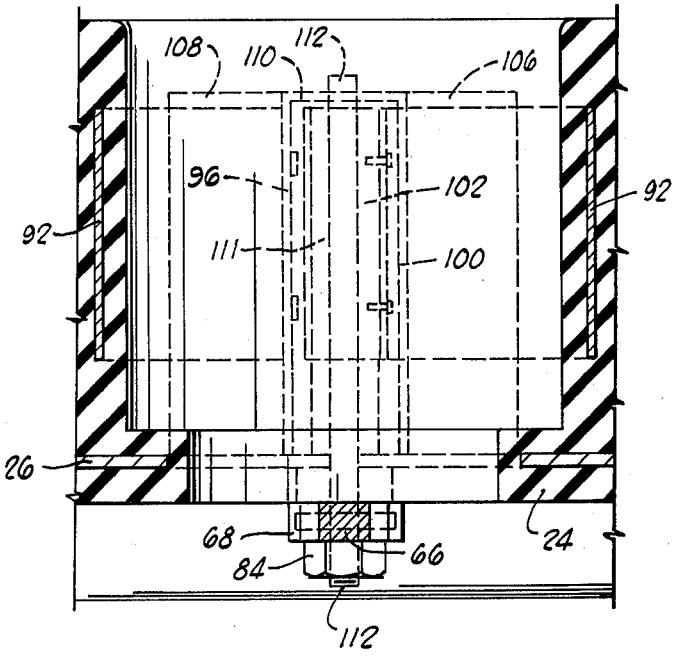
FIG. 8 is a detailed sectional view similar to that shown in FIG. 5, but illustrating certain details of construction of the alternate embodiment of the invention depicted in FIGS. 6–8.

An alternate embodiment of the invention is illustrated in FIGS. 6–8. Since, in this embodiment of the thread protector, several of the structural elements are identical to those which have been described in referring to FIGS. 1–5, identical reference numerals have been used to identify identical parts where they appear. Thus, the elastomeric sleeve 16 is formed integrally with an axially extending skirt 20 and a radially inwardly extending stop flange 24. The principal difference of the embodiment shown in FIGS. 6–8 from that which appears in FIGS. 1–5 is in the manner in which the constriction subassembly employed is constructed.

Thus, as shown in FIG. 6, the embodiment of thread protector there illustrated includes a constriction subassembly 90 which includes a flexible annular constriction band 92 which is embedded in the body of elastomeric material making up the sleeve 16. The constriction band 92 has one of its ends 94 suitably secured to one side 96 of a take-up drum housing, designated generally by reference numeral 98. The take-up drum housing 98 further includes a second side 100 extending substantially parallel to the side 96, with the sides 96 and 100 both extending substantially radially with respect to the axis of the pipe section 12 and the protector sleeve 16. The side 100 of the take-up drum housing 98 is slotted to permit the second end of the flexible constriction band 92 to be extended into the housing and secured to the outer periphery of a cylindrical take-up drum 102. The take-up drum housing 98 further includes an outer wall 104 which has a pair of anchoring flanges or wings 106 and 108 projecting therefrom and embedded in the elastomer body of the sleeve 16. Finally, the take-up drum housing 98 includes a top wall 110 and a front wall 111 which has its radially inner side covered by elastomer.

The take-up drum 102 is keyed to an axially extending operator shaft 112 which projects through an aperture formed in the top wall 110. At its other end, the operator shaft 112 passes through a sleeve 114, through the reinforcing plate 26, through a bearing nut 116 and out into the opening 22 formed within the skirt 20. The exposed end of the shaft 112 within the opening 22 is splined for engagement with an operator handle means 64 which is constructed identically to the operator handle means previously described in referring to FIGS. 1–5.

The embodiment of the invention illustrated in FIGS. 6–8 is used in substantially the same manner as the embodiment depicted in FIGS. 1–5. Thus, the described manipulation of the operator handle 66 as hereinbefore set forth effectively rotates the operator shaft 112 to cause the pick-up drum 102 to be rotated about its axis. Pivotation of the operator handle 66 in one direction causes the pick-up drum 102 to rotate in a clockwise direction as it is viewed in FIG. 7, and this rotary motion in turn shortens the flexible constriction band 92 and causes it to constrict, thereby forcing the elastomeric material radially inwardly therefrom against the pipe threads in a tight frictional engagement. Removal of the pipe thread protector is accomplished by pivoting the operator handle 66 in the opposite direction to cause counterclockwise rotation of the pick-up drum 102 and thereby relieve the tension in the constriction band 92. The elastomer in the sleeve 16 is thereby released from engagement with the external periphery of the pipe 12.

Although preferred embodiments of the pipe thread protector device of the invention have been herein described in detail, and are illustrated in the accompanying drawings, it will be apparent that various changes and innovations in the described and illustrated structure can be effected without departure from the basic principles which underlie the invention and upon which it is bottomed. Changes and structural innovations of this type are therefore deemed to be circumscribed by the spirit and scope of the invention, except as the same may be necessarily limited by the appended claims, or reasonable equivalents thereof.

What is claimed is:

1. A thread protector apparatus for protecting pipe threads comprising:

an annular elastomeric sleeve;

stop means extending radially inwardly from one end of the sleeve; and a constricting subassembly connected to the sleeve for constricting the elastomeric sleeve about an externally threaded pipe end, said constricting subassembly including:

a flexible band extending around and embedded within the elastomeric sleeve; and a shortening device engaging the flexible band for shortening its effective length to thereby constrict the flexible band and the annular elastomeric sleeve, said shortening device including:

drum means located within the elastomeric sleeve and engaging at least one end of the band for drawing the band to a constricted status, said drum means comprising:

a housing embedded within the elastomeric sleeve, said housing including:

a top wall;

a bottom wall;

guide flanges projecting toward each other from the top and bottom walls and guidingly contacting an end portion of said flexible band;

a pair of opposed, parallel side walls;

a back wall interconnecting said side walls and said top and bottom walls; and a pair of rigid stabilizer wings projecting from opposite side walls of the housing into the elastomer of said sleeve; and a sprocket drum within said housing and including teeth engaging slots spaced along said one end of the flexible band;

an operator shaft drivingly connected to the drum for rotating the drum, and including an end projecting from the end of the sleeve carrying the stop means and parallel to the axis of the sleeve; and operator handle means pivotally and detachably connected to the operator shaft for rotating the operator shaft and drum to shorten and constrict the flexible band.

2. A thread protector apparatus as defined in claim 1 wherein said operator handle means comprises:

an elongated handle having a bifurcated end portion;

a splined hub detachably engaged with said end of the operator shaft and having a neck pivotally connected to said bifurcated end portion of the handle.

3. A thread protector apparatus as defined in claim 2 wherein said stop means comprises:

a stop flange formed integrally with the elastomeric sleeve; and a radially extending metallic plate reinforcingly embedded in the sleeve and stop flange.

4. A thread protector apparatus for protecting pipe threads comprising:

an annular elastomeric sleeve;

stop means extending radially inwardly from one end of the sleeve; and a constricting subassembly connected to the sleeve for constricting the elastomeric sleeve about an externally threaded pipe end, said constricting subassembly including:

a flexible band extending around and embedded within the elastomeric sleeve; and a shortening device engaging the flexible band for shortening its effective length to thereby constrict the flexible band and the annular elastomeric sleeve, said shortening device including:

drum means located within the elastomeric sleeve, and engaging at least one end of the band for drawing the band to a constricted status;

an operator shaft drivingly connected to the drum means for rotating the drum means, and including an end projecting from the end of the sleeve carrying the stop means and parallel to the axis of the sleeve;

an elongated handle having a bifurcated end portion;

a splined hub detachably engaged with said end of the operator shaft and having a neck pivotally connected to said bifurcated end portion of the handle to facilitate utilizing said elongated handle for rotating the operator shaft and drum means to shorten and constrict the flexible band; and a removable nut detachably retaining said splined hub on said operator shaft.

5. A thread protector apparatus as defined in claim 2, wherein said stop means comprises:

a stop flange formed integrally with the elastomeric sleeve; and a radially extending metallic plate reinforcingly embedded in the sleeve and stop flange.

6. A thread protector apparatus as defined in claim 5 wherein said drum means comprises:

a sprocket drum; and teeth on said sprocket drum engaging said flexible band.

7. A thread protector apparatus for protecting pipe threads comprising:

an annular elastomeric sleeve;

stop means extending radially inwardly from one end of the sleeve; and a constricting subassembly connected to the sleeve for constricting the elastomeric sleeve about an externally threaded pipe end, said constricting subassembly including:

a flexible band extending around and embedded within the elastomeric sleeve; and a shortening device engaging the flexible band for shortening its effective length to thereby constrict the flexible band and the annular elastomeric sleeve, said shortening device including:

drum means located within the elastomeric sleeve and engaging at least one end of the band for drawing the band to a constricted status;

an operator shaft drivingly connected to the drum means for rotating the drum means, and including an end projecting from the end of the sleeve carrying the stop means and parallel to the axis of the sleeve;

an elongated handle having a bifurcated end portion; and a splined hub detachably engaged with said end of the operator shaft and having a neck pivotally connected to said bifurcated end portion of the handle to facilitate the pivotation of the handle about a horizontal axis, and to facilitate rotating the shaft and drum means to shorten and constrict the flexible band; and a latching stud projecting from said stop means for latching said elongated handle against movement relative to said sleeve.

8. A thread protector apparatus for protecting pipe threads comprising:

an annular elastomer sleeve;

stop means extending radially inwardly from one end of the sleeve; and a constricting subassembly connected to the sleeve for constricting the elastomeric sleeve about an externally threaded pipe end, said constricting subassembly including:

a flexible band extending around and embedded within the elastomeric sleeve; and a shortening device engaging the flexible band for shortening its effective length to thereby constrict the flexible band and the annular elastomeric sleeve, said shortening device including:

a housing embedded within the elastomeric sleeve;

a pair of rigid stabilizer wings projecting from opposite sides of the housing and in opposite directions into the elastomer of said sleeve for stabilizing the housing within the elastomer of the elastomeric sleeve;

a drum rotatably mounted in said housing out of contact with said elastomeric sleeve;

an operator shaft drivingly connected to the drum for rotating the drum in said housing, and including an end projecting from the end of said elastomeric sleeve carrying said stop means and projecting parallel to the axis of said elastomeric sleeve;

operator handle means pivotally and detachably connected to the operator shaft for rotating the shaft and drum to shorten and constrict the flexible band, said operator handle means including a handle pivotable about a horizontal axis; and a latching stud projecting from said stop means for latching said handle against movement relative to said sleeve.

9. A thread protector apparatus for protecting pipe threads comprising:

an annular elastomeric sleeve;

stop means extending radially inwardly from one end of the sleeve; and a constricting subassembly connected to the sleeve for constricting the elastomeric sleeve about an externally threaded pipe end, said constricting subassembly including:

a flexible band extending around and embedded within the elastomeric sleeve; and a shortening device engaging the flexible band for shortening its effective length to thereby constrict the flexible band and the annular elastomeric sleeve, said shortening device including:

drum means located within the elastomeric sleeve and engaging at least one end of the band for drawing the band to a constricted status, said drum means comprising:

a housing embedded within the elastomeric sleeve, said housing including:

a top wall;

a bottom wall;

guide flanges projecting toward each other from the top and bottom walls and guidingly contacting an end portion of said flexible band;

a pair of opposed, parallel side walls;

a back wall interconnecting said side walls and said top and bottom walls; and a pair of rigid stabilizer wings projecting from opposite side walls of the housing into the elastomer of said sleeve; and a drum within said housing and engaged with said flexible band for constricting said flexible band upon rotation of said drum;

an operator shaft drivingly connected to the drum for rotating the drum, and including an end projecting from the end of the sleeve carrying the stop means and parallel to the axis of the sleeve; and operator handle means pivotally and detachably connected to the operator shaft for rotating the operator shaft and drum means to shorten and constrict the flexible band.

10. A thread protector apparatus for protecting pipe threads comprising:

an annular elastomeric sleeve;

stop means extending radially inwardly from one end of the sleeve; and a constricting subassembly connected to the sleeve for constricting the elastomeric sleeve about an externally threaded pipe end, said constricting subassembly including:

a flexible band extending around and embedded within the elastomeric sleeve; and a shortening device engaging the flexible band for shortening its effective length to thereby constrict the flexible band and the annular elastomeric sleeve, said shortening device including:

drum means located within the elastomeric sleeve and engaging at least one end of the band for drawing the band to a constricted status, the drum means comprising:

a housing embedded within the elastomeric sleeve and being protectively covered by rubber on at least its radially outer side and at its axial ends; and a sprocket drum within said housing and spaced therefrom out of contact with any of the elastomer of said elastomeric sleeve, said sprocket drum including teeth engaging slots spaced along said one end of the flexible band;

an operator shaft drivingly connected to the sprocket drum for rotating the sprocket drum, and including an end projecting from the end of the sleeve carrying the stop means and parallel to the axis of the sleeve; and operator handle means pivotally and detachably connected to the operator shaft for rotating the shaft and sprocket drum to shorten and constrict the flexible band.

11. A thread protector apparatus as defined in claim 10 wherein said housing includes:

top and bottom walls having said operator shaft extending therethrough, a pair of opposed, parallel side walls, a back wall interconnecting said side walls and top and bottom walls, and further including guide flanges projecting toward each other from the top and bottom walls and guidingly contacting an end portion of said flexible band, said top wall, bottom wall, side walls, back wall and guide flanges having their surfaces outside said housing in contact with elastomeric material of said elastomeric sleeve.

12. A thread protector apparatus as defined in claim 10 wherein said operator handle means comprises:

an elongated handle having a bifurcated end portion; and a splined hub detachably engaged with said end of the operator shaft and having a neck pivotally connected to said bifurcated end portion of the handle.

13. A thread protector apparatus as defined in claim 12 wherein said housing includes top and bottom walls having said operator shaft extending therethrough, and further includes guide flanges projecting toward each other from the top and bottom walls and guidingly contacting an end portion of said flexible band, and wherein said stop means comprises:

a stop flange formed integrally with the elastomeric sleeve; and a radially extending annular metallic plate reinforcingly embedded in the sleeve and stop flange, and wherein said thread protector apparatus further includes a sleeve surrounding said operator shaft and having one end abutting said stop flange, and its other end bearing against said sprocket drum wherein said drum is stably supported within said housing.

14. A thread protector apparatus for protecting pipe threads comprising:

an annular elastomeric sleeve;

stop means extending radially inwardly from one end of the sleeve; and a constricting subassembly connected to the sleeve for constricting the elastomeric sleeve about an externally threaded pipe end, said constricting subassembly including:

a flexible band extending around and embedded within the elastomeric sleeve; and a shortening device engaging the flexible band for shortening its effective length to thereby constrict the flexible band and the annular elastomeric sleeve, said shortening device including:

drum means located within the elastomeric sleeve and engaging at least one end of the band for drawing the band to a constricted status, said drum means comprising:

a housing completely embedded within the elastomeric sleeve and protectively covered by elastomer on all sides thereof; and a take-up drum rotatably mounted in said housing out of any contact with the elastomer of said elastomeric sleeve;

an operator shaft drivingly connected to the take-up drum for rotating the take-up drum, and including an end projecting from the end of the sleeve carrying the stop means and parallel to the axis of the sleeve; and operator handle means pivotally and detachably connected to the operator shaft for rotating the shaft and take-up drum to shorten and constrict the flexible band.

15. A thread protector apparatus as defined in claim 14 wherein said operator handle means comprises:

an elongated handle having a bifurcated end portion;

a splined hub detachably engaged with said end of the operator shaft and having a neck pivotally connected to said bifurcated end portion of the handle.

16. A thread protector apparatus as defined in claim 15 wherein said stop means comprises:

a stop flange formed integrally with the elastomeric sleeve; and a radially extending metallic plate reinforcingly embedded in the sleeve and stop flange.

* * * * *